US007178778B2

(12) United States Patent
Lee

(10) Patent No.: US 7,178,778 B2
(45) Date of Patent: Feb. 20, 2007

(54) PORTABLE EASEL

(75) Inventor: W. Samuel Lee, Taylors, SC (US)

(73) Assignee: Fuji Photo Film, Inc., Greenwood, SC (US)

( * ) Notice: Subject to any disclaimer, the term of this patent is extended or adjusted under 35 U.S.C. 154(b) by 0 days.

(21) Appl. No.: 10/967,460

(22) Filed: Oct. 18, 2004

(65) Prior Publication Data

US 2006/0081758 A1 Apr. 20, 2006

(51) Int. Cl.
*A47B 97/04* (2006.01)

(52) U.S. Cl. ..... 248/459; 248/174

(58) Field of Classification Search ..... 248/459, 248/441.1, 174, 460
See application file for complete search history.

(56) References Cited

U.S. PATENT DOCUMENTS

| | | | | | |
|---|---|---|---|---|---|
| 1,379,612 | A | | 5/1921 | Baver | |
| 1,411,281 | A | | 4/1922 | Kellogg | |
| 1,881,707 | A | * | 10/1932 | Larkin | 211/73 |
| D90,769 | S | * | 9/1933 | Kamen | D19/36 |
| 2,142,826 | A | | 1/1939 | Rosello | |
| 2,485,517 | A | | 10/1949 | Vaule et al. | |
| 2,490,356 | A | * | 12/1949 | Hummel | 248/463 |
| 2,641,964 | A | * | 6/1953 | Jaros | 355/72 |
| 2,646,143 | A | * | 7/1953 | Daleo et al. | 206/45.25 |
| 2,647,834 | A | * | 8/1953 | Rabkin et al. | 430/496 |
| 2,726,835 | A | | 12/1955 | Hummel | |
| 2,805,160 | A | * | 9/1957 | Griggs et al. | 430/536 |
| 2,806,608 | A | | 9/1957 | Collura | |
| 2,962,825 | A | * | 12/1960 | Bravo et al. | 40/367 |
| 2,975,905 | A | | 3/1961 | Foland | |
| 3,041,774 | A | * | 7/1962 | Walker | 248/451 |
| 3,097,444 | A | * | 7/1963 | Steiner | 248/454 |
| 3,410,516 | A | | 11/1968 | Criswell | |
| 3,599,925 | A | | 8/1971 | Dubler | |
| 4,105,182 | A | * | 8/1978 | Jacobson | 248/459 |
| 4,213,520 | A | * | 7/1980 | Sarna et al. | 248/444.1 |
| 4,544,123 | A | * | 10/1985 | Peacock | 248/460 |
| 4,607,817 | A | | 8/1986 | Aquino | |
| 4,709,895 | A | * | 12/1987 | Mardak | 248/460 |
| 4,722,504 | A | | 2/1988 | Degenholtz | |
| 4,811,042 | A | * | 3/1989 | Cloutier et al. | 396/213 |
| 4,886,231 | A | * | 12/1989 | Doerksen | 248/455 |
| 5,010,671 | A | * | 4/1991 | Stonehouse | 40/594 |
| 5,024,898 | A | | 6/1991 | Pitts et al. | |
| 5,080,316 | A | * | 1/1992 | MacEwan | 248/459 |
| 5,207,581 | A | | 5/1993 | Boyd | |
| 5,388,861 | A | * | 2/1995 | Reiter | 281/4 |
| 5,393,030 | A | * | 2/1995 | Tarozzi | 248/460 |
| 5,555,614 | A | * | 9/1996 | Book | 29/401.1 |
| 5,586,786 | A | * | 12/1996 | Su | 281/33 |

(Continued)

OTHER PUBLICATIONS

Picture of 3M portable pad of paper.

*Primary Examiner*—Anita M. King
(74) *Attorney, Agent, or Firm*—McNair Law Firm, P.A.

(57) ABSTRACT

This invention is a collapsible panel assembly having a front panel, a back panel, and at least one dry erase sheet carried by said front panel. The invention can have a first position where the collapsible panel assembly is generally a triangular shape and a second position where the collapsible panel assembly is generally arranged in a stacked configuration. Dry erase sheets can be removed from the front panel to reveal underlying sheets.

13 Claims, 5 Drawing Sheets

U.S. PATENT DOCUMENTS 5,711,101 A 1/1998 Mueller et al.
5,722,628 A * 3/1998 Menaged ..... 248/441.1
6,251,500 B1 6/2001 Varga et al.
6,493,969 B2 * 12/2002 Devos ..... 40/120
6,648,051 B1 11/2003 Young
6,746,051 B1 6/2004 Archie, Jr. et al.
6,758,333 B2 7/2004 Sherman
6,878,414 B2 * 4/2005 Meccia et al. ..... 427/495
2001/0024720 A1 9/2001 Sweet et al.
2001/0040207 A1 11/2001 Richardson
2003/0150828 A1 8/2003 Bennett et al.

* cited by examiner

PORTABLE EASEL

FIELD OF THE INVENTION

This invention is directed toward an easel, and more particularly, a collapsible portable easel carrying dry erase sheets which can be removed from the easel.

BACKGROUND OF THE INVENTION

It has been long proven that one of the most effective means of communication is through the use of visual aids such as charts, graphs, drawings, and other visual materials. Particularly, the use of flip charts and "butcher paper" have facilitated the conveyance of thoughts, ideas, and plans, and have been used to convey information from presenters to audiences. With the improvements in technology, we have seen presentation devices such as overhead projectors, dry erase easels, dry erase boards, and, of course, the frequent use of Power Point presentations.

Further, and in response to a significantly more mobile workforce, we have seen the development of the laptop, the portable projector, and the portable easel with flipchart paper. Particularly, 3M markets a portable pad of paper that allows for sheets to be used and then removed from the pad so that the subsequent underlying sheet can then be further used. A disadvantage of 3M's product is the need to have a significant number of sheets for practical use in contrast with maintaining a fairly lightweight means of transportation. Although generally lightweight and portable, having too many sheets creates practical weight limitations.

To overcome the limitations of the number of non-reusable sheets in a portable paper easel, there have been some attempts to use dry erase board material in a portable format. For example, U.S. Patent Application Publication No. 2001/0040207-A1 is directed toward a portable display board system that shows a writing surface that could comprise a dry erase board with two panels that can be collapsed for carrying. U.S. Pat. No. 6,648,051 is directed toward a foldable dry erase surface. U.S. Pat. No. 5,207,581 is directed to a roll erasable medium that can be pulled down and cut into separate sheets. Typically, attempts for a plurality of sheets to be in a foldable easel arrangement have not been achieved due to the fact that dry erase material comes in too flexible a medium such as that disclosed in U.S. Pat. No. 6,251,500-B1, or too rigid an inflexible material due to a ceramic or other rigid substrate for the dry erase board.

Although these attempts to create portable dry erase boards have had some success, a number of problems are still associated with these inventions. For example, over time, the surface of the dry erase board begins to degrade and the dry erase board tends to retain traces of the dry erase markers. This residual dry erase ink produces an effect called "ghosting." While ghosting can be minimized by cleaning solutions, the problem will increase over time. In spite of these attempts, there is still a need for a portable easel having a plurality of reusable dry erase sheets. Additionally, there is a need for a portable easel that is easy to transport and has an effective writing surface of many sheets.

SUMMARY OF THE INVENTION

A portable easel comprising a collapsible panel assembly having a front panel hingeably connected to a back panel, and at least one dry erase sheet carried by the front panel for providing a reusable writing surface. The collapsible panel has a first position wherein the front panel and the back panel generally form a triangular shape allowing the easel to be positioned in an upright position and a second position wherein the front panel and the back panel are arranged in a stacked configuration allowing for easy transportation and storage of the easel.

In a further embodiment, at least one perforation is embodied within the at least one dry erase sheet so that the dry erase sheet can be removed from the front panel. Further, the at least one dry erase sheet is comprised of photograph paper substrate.

In a further embodiment, at least one connecting member is included, which is attached to the front panel and the back panel to allow the portable easel to form generally a triangular shape in the first position. Further, a securing member is included for securing the front panel and the back panel in the second position.

In a further embodiment, the front panel defines at least one hole for receiving fastening members, the dry erase sheet defines at least one hole for receiving fastening members, and, at least one fastening member is included for attaching the at least one dry erase sheet to the front panel.

In a further embodiment, a utility tray is carried by the front panel. Further, a utility tray cover is carried by the front panel for securing writing implements in the utility tray.

In a further embodiment, a base panel is carried by the back panel, and a utility tray is carried by the back panel allowing for the storage of writing implements or erasing utilities for use with the dry erase sheet. Further, a utility tray cover is carried by the base panel for securing writing implements within the utility tray. Yet further, a handle is carried by the base panel. Yet further, the base panel includes a first interior panel pivotally connected to a second interior panel so that when the first interior panel and the second interior panel are superimposed, the base panel's length is shortened so that the easel, in the open position, forms generally an isosceles triangle.

In a further embodiment, the invention comprises a collapsible easel having a first panel hingeably connected to a second panel being arranged in generally a triangular configuration, and at least one dry erase sheet carried by the first panel for providing a reusable writing surface.

In a further embodiment, the at least one dry erase sheet is comprised of photographic paper substrate.

In a further embodiment, at least one connecting member is included attached to the front panel and the back panel to allow the easel to form generally a triangle when in the first position.

In a further embodiment, a utility tray is carried by the front panel.

In a further embodiment, a utility tray cover is carried by the front panel for securing writing implements in the utility tray.

In a further embodiment, a base panel is hingeably connected to the back panel.

In a further embodiment, a utility tray is carried by the back panel allowing for the storage of writing implements for use with the dry erase sheet.

In a further embodiment, a utility tray cover is pivotally connected to the base panel.

In a further embodiment, a handle is carried by the utility tray cover.

In a further embodiment, at least one perforation is embodied within the at least one dry erase sheet so that the dry erase sheet can be removed from the front panel.

DESCRIPTION OF THE DRAWINGS

The invention can be understood with reference to the following drawings.

DETAILED DESCRIPTION OF THE INVENTION

This invention is described in detail so as to provide the best mode of this invention to those skilled in the art. Although specifics have been used to describe the invention, this description is not to be construed nor is it intended so as to limit the scope of the claims of this invention.

Figure 1:
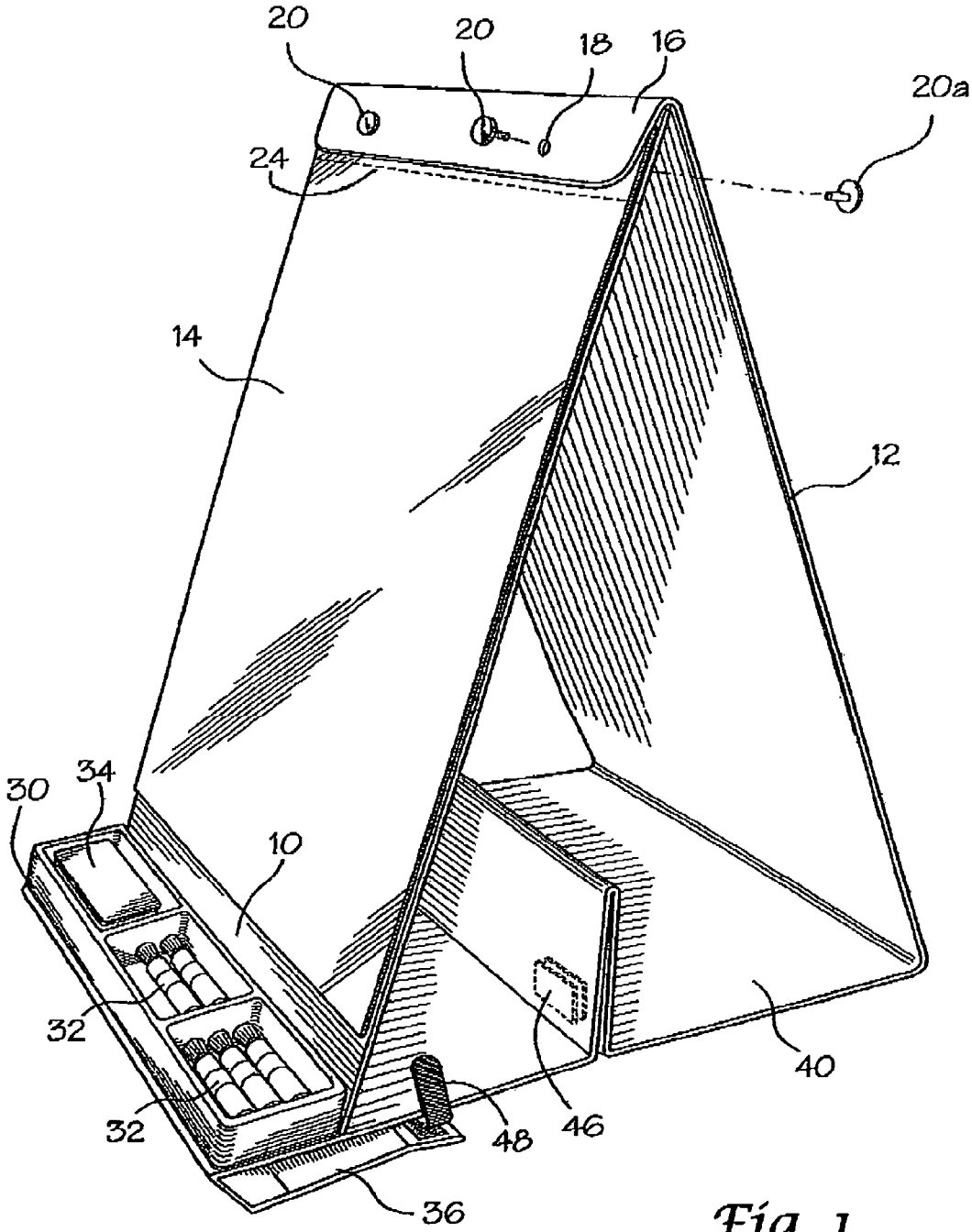
FIG. 1 is a perspective view of the invention.

Referring to FIG. 1, the invention is described in more detail. A collapsible panel assembly is shown having a front panel 10 hingeable connected to a back panel 12. The front panel carries at least one dry erase sheet 14. In one embodiment, a plurality of dry erase sheets are connected to the front panel. The dry erase sheet operates to receive and releasably retain a marking composition such as dry erase markers. For example, a solvent-based ink can be used on the dry erase sheet and can be easily removed by wiping the sheet with an eraser, sponge, paper towel, cloth, or other material. The dry erase sheet can comprise photograph paper substrate that does not have a photographic emulsion.

Figure 1A:
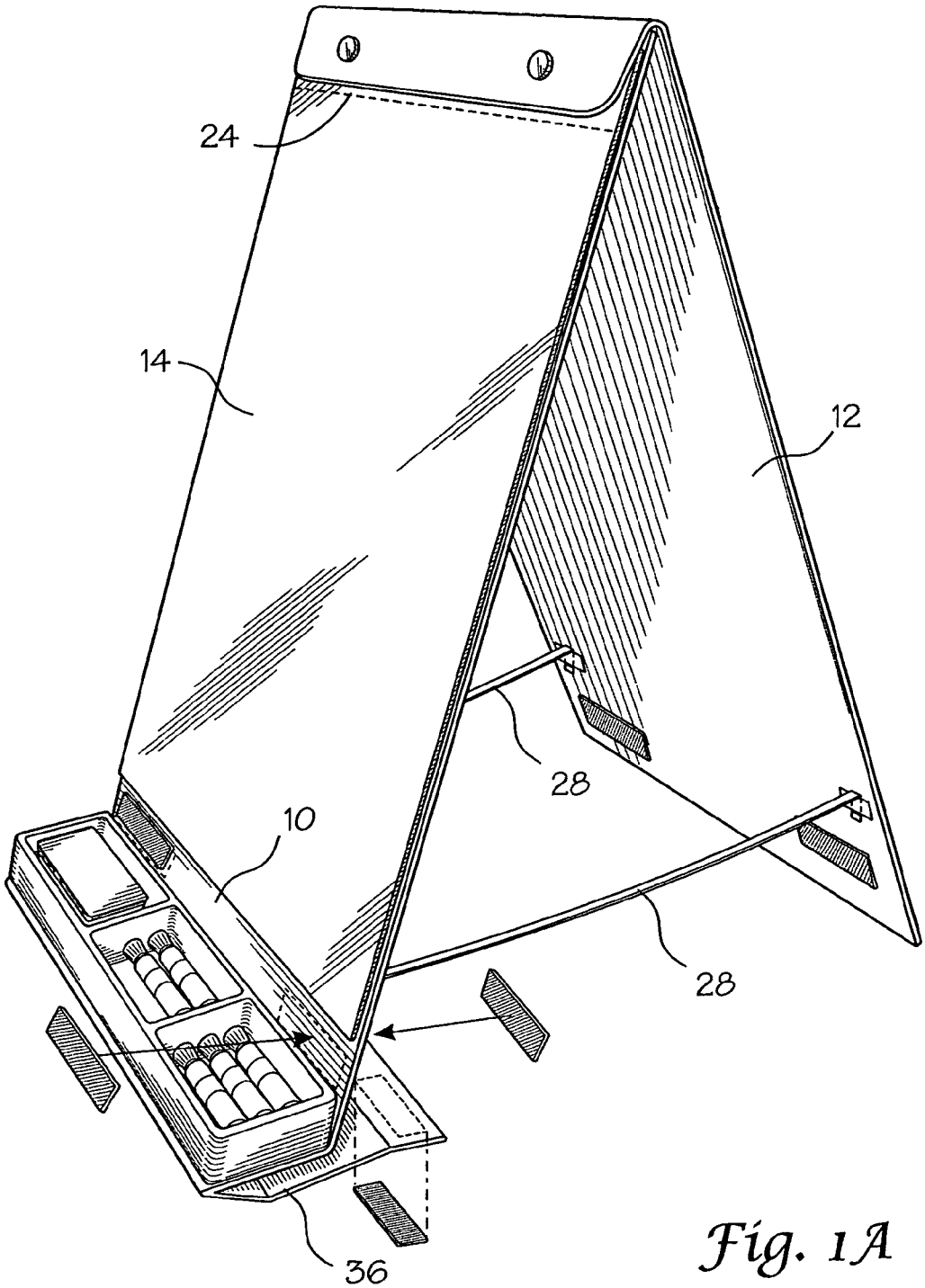
FIG. 1A is a perspective view of the invention.

In one embodiment, the back panel can include a top flap 16 that defines an opening 18 which receives a fastening member such as one having a threaded anchor 20*a*. Front panel 10 can also define an opening (not shown) that receives a bolt 20 so that the anchor 20*a* prevents the bolt from traveling completely through the front and back panels. The dry erase sheet can also define an opening for receiving the bolt so that the front panel, dry erase sheet, and back panel flap 16 are arranged in a planer configuration. In another embodiment, fastening member (FIG. 1A) can comprise a threaded post and nut combination, rivet, punch or other member for securing the dry sheet to the front panel.

In another embodiment, the front panel and back panel are hingeably connected without flap 16 so the anchor is carried by the front panel and in turn receives the bolt.

In one embodiment, the dry erase sheet can have a perforation 24 along the upper portion of the sheet, allowing the dry erase sheet to be removed from the front panel. The dry erase sheet can then be attached to the front panel above the perforation allowing the dry erase sheet to be removed from the front panel. In the event a plurality of dry erase sheets are present, each sheet can be removed allowing the underlying sheet to be revealed and therefore used. Perforations of each sheet would facilitate the ease of removal of such sheets.

Further, a connecting member 28 can be carried by the front and back panel so that the front and back panel can form a first position generally triangular in shape and a second position generally stacked arrangement for ease of transportation and storage. Since the front panel and the back panel are hingeably connected, the connecting member can prevent the front panel and back panel from over-rotation and facilitate the front panel and back panel forming a general triangular shape. Further, connecting member 28 can comprise flexible material such as thread or can be hinged so as to collapse when in the second position.

Figure 2:
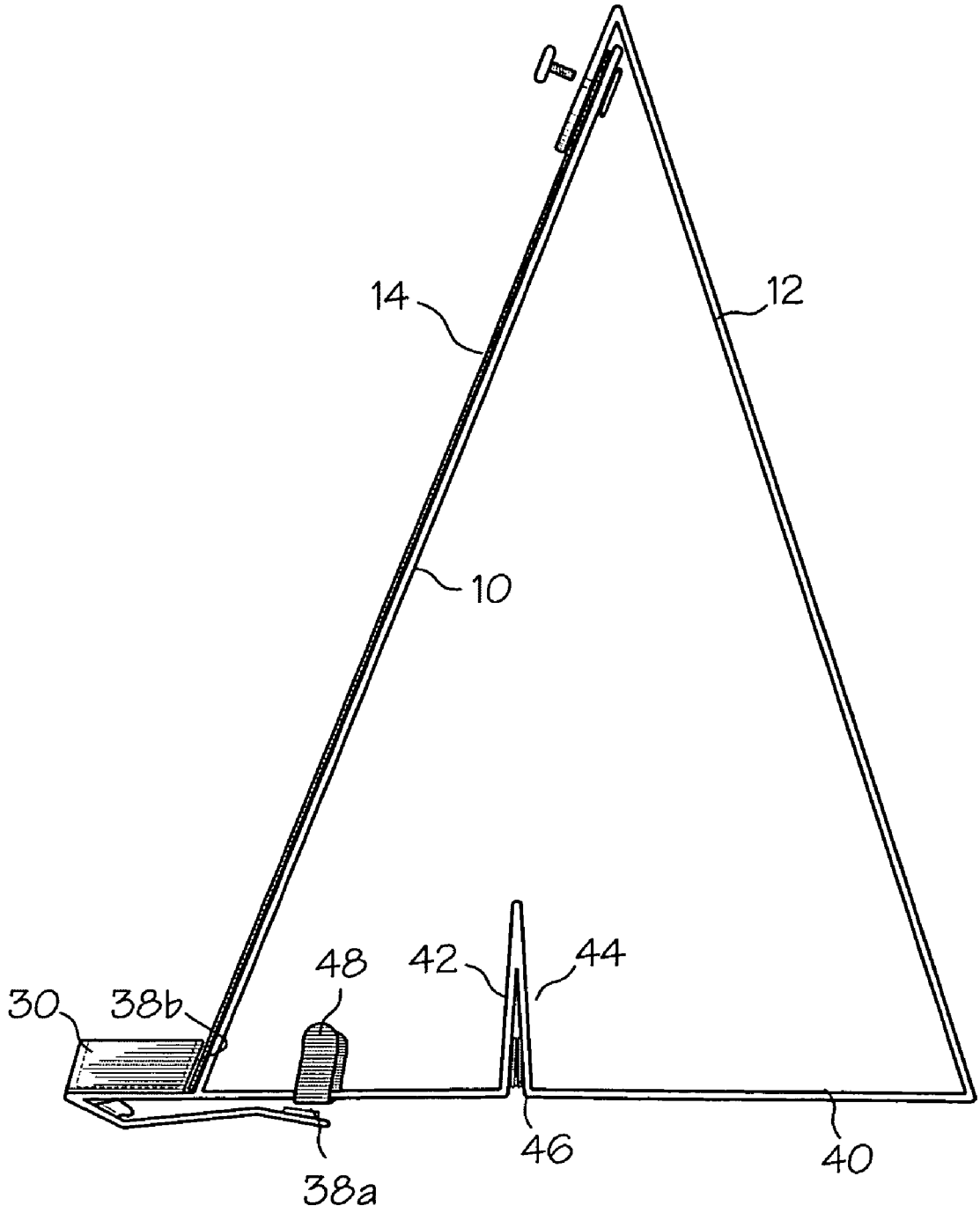
FIG. 2 is a side view of the invention.

A utility tray 30 can be carried by the front panel and can he used to carry such items as dry erase markers 32, eraser 34, and other such items. A utility tray cover 36 can be hingeably carried by the front panel so that the utility tray cover can be arranged to enclose the utility tray for securing items such as dry erase markers and erasers within the utility tray for storage or transportation. The utility tray cover can include hook and loop connectors such as Velcro, or other fasteners, to secure the utility tray cover in a closed position. Referring to FIG. 2, a portion 38*a* of a hook and loop connector can be carried by the utility tray cover so that it can join a second portion 38*b* of the hook and loop connector to secure the utility tray cover in a closed position.

In another embodiment, a base panel 40 can be hingeably carried by the back panel. The utility fray may be attached to the base panel and the utility tray cover can be formed from the base panel. The base panel can include a first interior panel 42 and a second interior panel 44. In its open position, the first and second interior panels are superimposed so that the horizontal length of base panel 40 is shortened so that the front, back, and base panels form generally an isosceles triangle. In this configuration, front panel 14 can abut utility tray 30 so that the front panel bottom edge does not travel more than a predetermined distance from the back panel. Interior panel fasteners 46, such as hook and loop connectors, straps, ties, or clamps, secure the first and second interior panels in the superimposed position.

In its closed position, securing member 48 can secure the front panel, the second panel, and the base panel in generally a stacked position. Securing members may comprise any of hook and loop connectors, snaps, ties, clips, or clamps. Securing member can also be carried by said back panel to secure said front panel and said back panel in the closed position.

An adjustable handle can be carried by the utility tray cover so that the easel can be carried by the handle.

Figure 3:
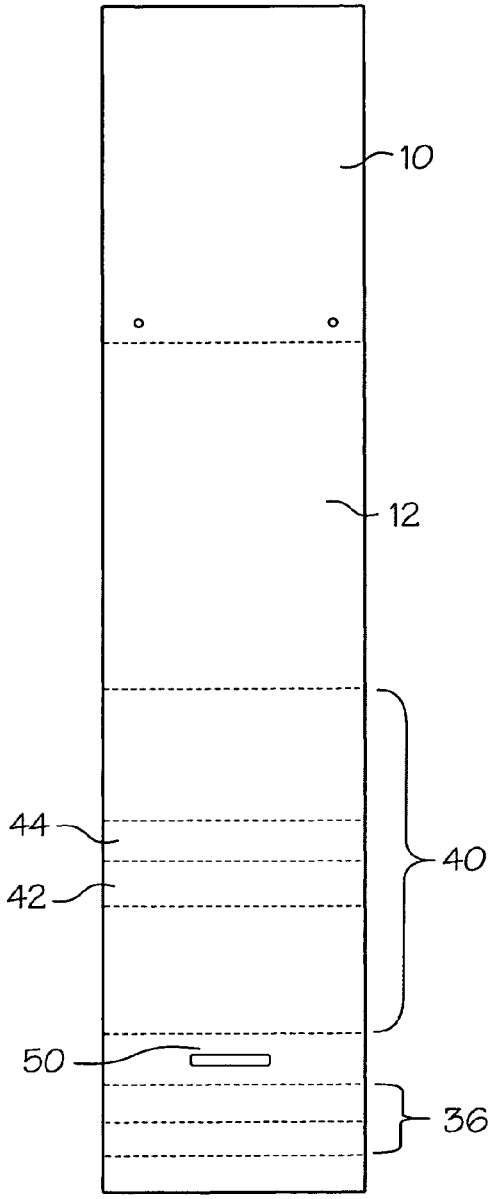
FIG. 3 is a top view of the invention unfolded.

Referring now to FIG. 3, an embodiment of the invention is described in an unfolded configuration. Front panel 10 which can define holes for receiving fastening members, is hingeably connected to back panel 12 which is hingeably connected to base panel 40. The base panel can have a first interior panel 42 and a second interior panel 44. The base panel can be hingeably connected to utility tray cover 36. The various panels can be manufactured from one piece of material, such as corrugated board, so that the hingeable connections can be achieved through perforations or scoring the piece of material to define each of the described panels.

Figure 4:
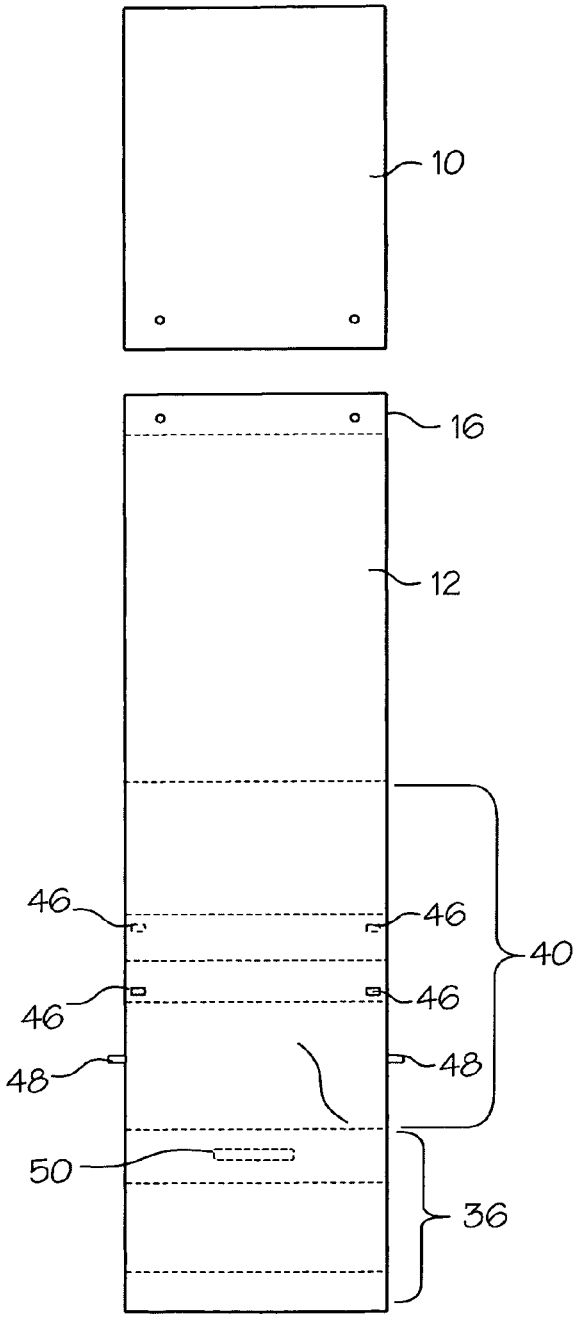
FIG. 4 is a top view of the invention unfolded.

Referring now to FIG. 4, one embodiment of the invention is described in an unfolded configuration. Front panel 10 is shown defining holes for receiving fastening members. Dry erase sheets (not shown) are carried by the front panel. Back panel 12 is shown having flap 16 hingeably connected to the back panel. Base panel 40 can be hingeably connected to the back panel and can have interior panels 42 and 44. Utility tray cover 36 can be hingeably connected to the base panel and can have handle 50. Further, utility tray cover 36 can be hingeably attached to the front panel.

Figure 5:
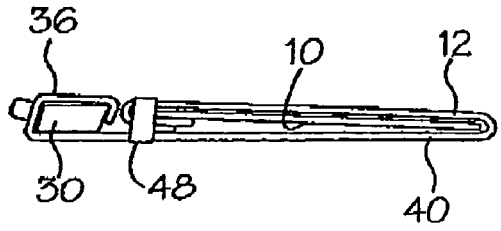
FIG. 5 is a side view of the invention.

Referring now to FIG. 5, one embodiment of the invention is shown in its closed position with the utility tray cover securing the utility tray.

Figure 6:
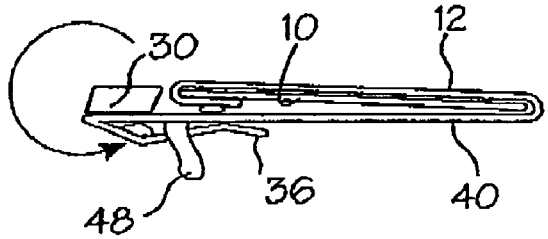
FIG. 6 is a side view of the invention.

Referring now to FIG. 6, one embodiment of the invention is shown in its closed position with the utility tray cover open.

Figure 7:
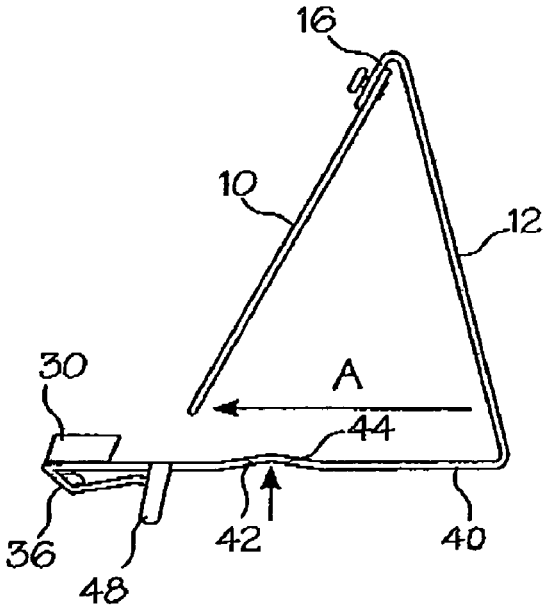
FIG. 7 is a side view of the invention; and,
FIG. 8 is a side view of the invention.

Referring now to FIG. 7, one embodiment of the invention is shown with front panel being unfolded in a direction shown as generally A so that the bottom edge of the front page can abut the utility tray. The base panel interior panels are being positioned in the direction shown generally as A so as to place the invention in an open position.

Figure 8:
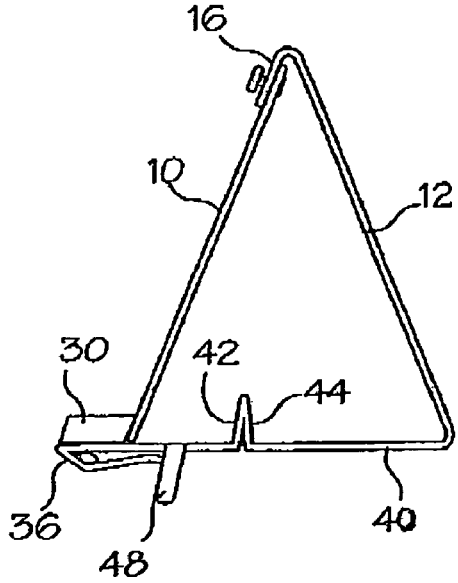

Referring now to FIG. 8, one embodiment of the invention is shown with the interior panels of the base panel superimposed and the bottom edge of the front panel abutting the utility tray to form generally an isosceles triangle.

What is claimed is:

1. A portable easel comprising:

a collapsible panel assembly having a back panel hingeably connected to a front panel and a base panel, said base panel having an extended position and a retracted position;

at least one sheet of photographic paper carried by said front panel providing a reusable writing surface said sheet of photographic paper being substantially free of photographic emulsion;

said collapsible panel assembly having a first position in which said base panel is in said retracted position allowing said front panel and said back panel to generally form a triangular shape allowing said easel to be positioned in an upright position and a second position in which said base panel is in said extended position allowing said front panel and said back panel to be arranged in a stacked configuration allowing for easy transportation and storage of said easel.

2. The portable easel of claim 1 including at least one perforation embodied within said at least one sheet of photographic paper so that said sheet can be removed from said front panel.

3. The portable easel of claim 1 including a securing member for securing said front panel and said back panel in said second position.

4. The portable easel of claim 1 including at least one fastening member for attaching said at least one sheet of photographic paper to said front panel; and said front panel and said sheet of photographic paper each defining at least one hole for receiving said at least one fastening member.

5. The portable easel of claim 1 including:

a utility tray carried by said base panel allowing for the storage of writing implements or erasing utilities for use with said sheet of photographic paper.

6. The portable easel of claim 5 including a utility tray cover carried by said base panel for securing writing implements within said utility tray.

7. The portable easel of claim 5 including a handle carried by said base panel.

8. A portable easel comprising:

a collapsible panel assembly having a front panel hingeably connected to a back panel;

at least one sheet of dry erase paper earned by said front panel providing a reusable writing surface;

a utility tray carried by said front panel;

a utility tray cover carried by said front panel for securing writing implements in said utility tray; wherein, said collapsible panel assembly has a first position wherein said front panel and said back panel generally form a triangular shape allowing said easel to be positioned in an upright position and a second position wherein said front panel and said back panel are arranged in a stacked configuration allowing for easy transportation and storage of said easel.

9. The portable easel of claim 8 including at least one connecting member, attached to said front panel and said back panel to allow said portable easel to form generally a triangular shape in said first position.

10. The portable easel of claim 8 including a base panel interconnected with said front and back panels, said base panel includes a first interior panel pivotally connected to a second interior panel so that when said first interior panel and said second interior panel are superimposed, said base panel is in said retracted position.

11. The portable easel of claim 8 including at least one connecting member attached to said front panel and said back panel to allow said easel to form generally a triangle when in said first position.

12. A portable easel comprising:

a collapsible easel having a first panel hingeably connected to a second panel, said second panel being hingeably connected to a base panel, said panels being arranged in generally a triangular configuration;

at least one dry erase sheet carried by said first panel for providing a reusable writing surface;

a utility tray carried by said base panel engaging with an end of said first panel while allowing for the storage of writing implements for use with said dry erase sheet; and, a utility tray cover pivotally connected to said base panel.

13. The portable easel of claim 12 including a handle carried by said utility tray cover.

* * * * *